United States Patent [19]

Kimball et al.

[11] 4,213,170

[45] Jul. 15, 1980

[54] REFLECTOR LAMP WITH LENS HAVING LIGHT-MODIFYING COATING

[75] Inventors: Stephen F. Kimball, Andover; Roy C. Martin, Salem, both of Mass.

[73] Assignee: GTE Sylvania Incorporated, Stamford, Conn.

[21] Appl. No.: 875,287

[22] Filed: Feb. 6, 1978

[51] Int. Cl.[2] ..... F21V 29/00

[52] U.S. Cl. ..... 362/267; 362/300; 362/306

[58] Field of Search ..... 362/16, 18, 19, 2, 300, 362/306, 326, 9, 361, 267

[56] References Cited

U.S. PATENT DOCUMENTS

| | | | |
|---|---|---|---|
| 3,188,218 | 6/1965 | Elmer et al. | 362/2 X |
| 3,355,982 | 10/1967 | Rendina | 362/2 X |
| 3,588,488 | 6/1971 | Lauterback | 362/2 X |
| 4,072,856 | 2/1978 | Eligehausen | 362/16 X |
| 4,120,023 | 10/1978 | McReynolds, Jr. | 362/16 |

*Primary Examiner*—Peter A. Nelson

*Attorney, Agent, or Firm*—James Theodosopoulos

[57] ABSTRACT

An electric lamp comprises a curved reflector having a double ended tungsten-halogen lamp disposed therein. A lens is fastened to the front of the reflector by means of a metal retaining ring. The lens has a light-modifying coating on its inner surface.

1 Claim, 2 Drawing Figures

REFLECTOR LAMP WITH LENS HAVING LIGHT-MODIFYING COATING

THE INVENTION

This invention concerns an incandescent reflector lamp having a tungsten-halogen lamp disposed within a housing that comprises a reflector and a front lens, the lens having a coating thereon to modify the color of the light emitted by the lamp. The advantage of this invention is that the front lens need not be hermetically sealed to the reflector. The lens is simply secured to the reflector by means of a metal retaining ring. This permits the coating to be placed on the inner surface of the lens where it is protected from scratching.

Figure 1:
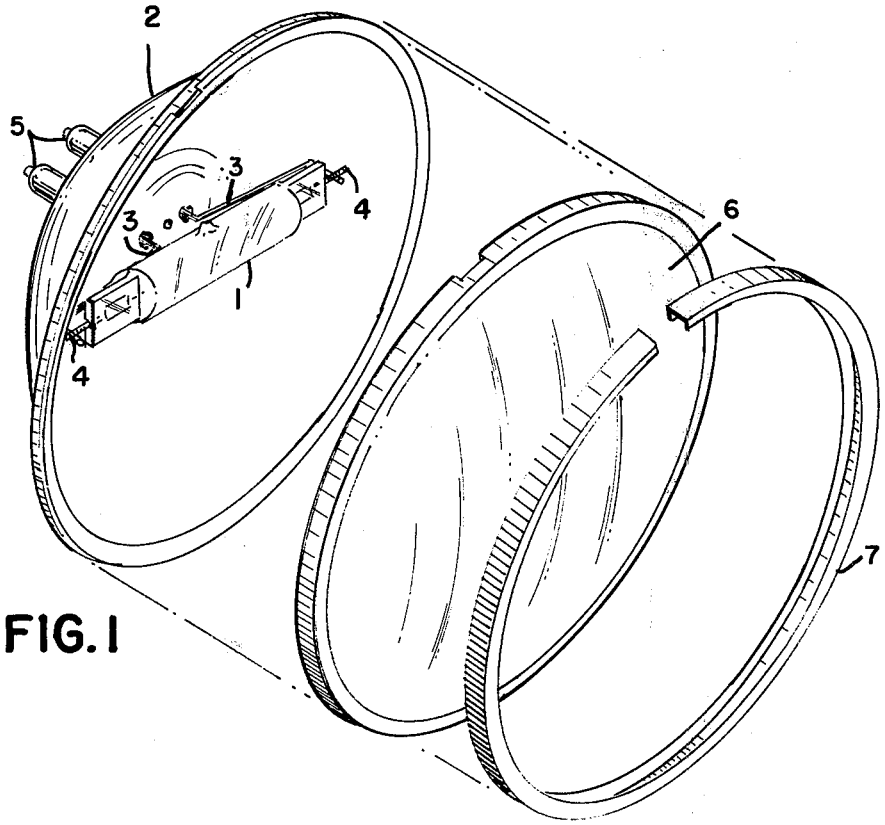
FIG. 1 is an exploded perspective drawing of a reflector lamp in accordance with this invention.

Tungsten-halogen lamp 1 is double-ended, of the type shown in U.S. Pat. No. 3,242,372, for example, and is supported in parabolic reflector 2 by means of two support rods 3. Support rods 3 are connected to lead-in wires 4 at the ends of lamp 1 and to metal ferrules 5 which are glass-to-metal sealed to the back of reflector 2. At the front of reflector 2 is a transparent glass lens 6 which transmits the light emitted by lamp 1. Lens 6 has a coating on its inner surface to modify the color of the light transmitted through lens 6. The coating may be, for example, a dichroic coating that elevates the color temperature of the light to 5000° Kelvin for photography purposes.

To prevent the need of glass sealing or adhesive bonding of lens 6 to reflector 2, a metal retaining ring 7 is used to fasten lens 6 to reflector 2. Such an arrangement can be used because a hermetic seal therebetween is not needed, since lamp 1 is itself hermetically sealed.

Figure 2:
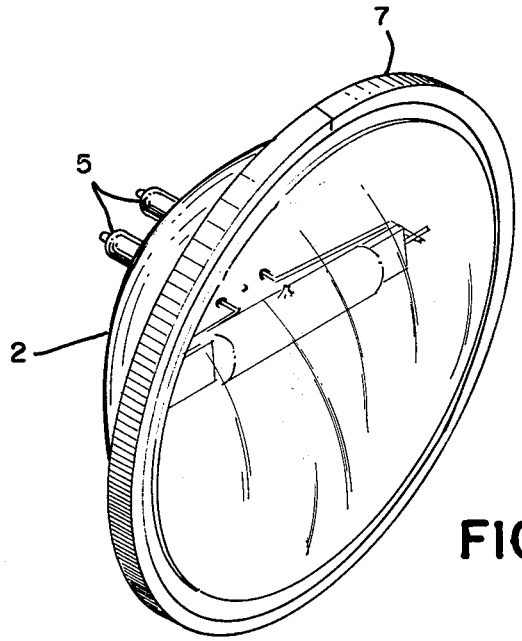
FIG. 2 shows the complete lamp.

In one example for a 650 watt, 24,000 candlepower lamp, the diameters of reflector 2 and lens 6 were about 4½ inches. Retaining ring 7 was made of 12 mil thick deep draw quality stainless steel and was split, as shown in FIG. 1, to enable it to be slipped over the mating edges of reflector 2 and lens 6. Lens 6 had bosses at its periphery which mated with corresponding indents on reflector 2 in order to properly locate lens 6 on reflector 2. As shown in FIG. 1, ring 7 was essentially U shaped and bent into a circle with its ends not joined, as mentioned above. The width of the U was about 5/16" and each leg or rim was about ⅛". At assembly, the circular band comprising one rim of ring 7 bears against the back of the peripheral edge of reflector 2 and the circular band comprising the other rim bears against the front of the peripheral edge of lens 6, thereby clamping reflector 2 and lens 6 together. One end of ring 7 is smaller than the other so that it nests therein at assembly, as shown in FIG. 2. After ring 7 is drawn tight, its ends are welded or brazed together.

We claim:

1. An electric lamp comprising: a curved reflector having a circular front and a peripheral edge thereat; a double ended tungsten halogen lamp disposed within the curved reflector; and a circular lens, having a light-modifying coating on the inner surface thereof and having a peripheral edge, fastened to the circular front of the reflector by means of a split metal ring that encircles said edges of the reflector and lens and clamps them together, said split metal ring being essentially U shaped and bent into a circle, one leg of the U bearing against the back of the peripheral edge of the reflector and the other leg of the U bearing against the front of the peripheral edge of the lens.

* * * * *